US008820073B2

(12) United States Patent
Nikpour

(10) Patent No.: US 8,820,073 B2
(45) **Date of Patent: *Sep. 2, 2014**

(54) COMPRESSOR

(75) Inventor: Bahram Nikpour, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/469,663

(22) Filed: May 11, 2012

(65) Prior Publication Data

US 2012/0266593 A1 Oct. 25, 2012

Related U.S. Application Data

(63) Continuation of application No. 12/500,428, filed on Jul. 9, 2009, now Pat. No. 8,256,218, which is a continuation of application No. PCT/GB2008/000176, filed on Jan. 18, 2008.

(30) Foreign Application Priority Data

Jan. 19, 2007 (GB) ..... 0701012.7

(51) Int. Cl.

| | |
|---|---|
| ***F02B 33/44*** | (2006.01) |
| ***F04D 27/02*** | (2006.01) |
| ***F04D 23/00*** | (2006.01) |
| ***F04D 29/18*** | (2006.01) |
| ***F04D 29/26*** | (2006.01) |
| ***F04D 29/42*** | (2006.01) |
| ***F04D 29/44*** | (2006.01) |
| ***F04D 29/70*** | (2006.01) |

(52) U.S. Cl.

CPC ..... *F04D 29/701* (2013.01); *F04D 27/0207* (2013.01); *F04D 29/4213* (2013.01)

USPC ..... 60/605.1; 415/1; 415/58.3; 415/58.4

(58) Field of Classification Search

CPC ..... F04D 27/0207; F04D 29/4213; F04D 29/701; F05B 2220/40

USPC ..... 60/605.1; 415/1, 11, 58.3–58.4, 415/205–206, 145, 116, 914; 123/572

IPC ..... F01D 9/02; F04D 29/02,29/66

See application file for complete search history.

(56) References Cited

U.S. PATENT DOCUMENTS 3,004,494 A 10/1961 Corbett
3,041,848 A 7/1962 Greenwald (Continued)

FOREIGN PATENT DOCUMENTS

DE 4213047 A1 10/1993
DE 10112764 A1 * 9/2002 ..... F02D 29/66

(Continued)

OTHER PUBLICATIONS

ISA/European Patent Office, International Search Report PCT/GB2008/000176, Cummins Turbo Technologies Limited, Apr. 22, 2008.

(Continued)

*Primary Examiner* — Thai Ba Trieu

(74) *Attorney, Agent, or Firm* — Krieg DeVault LLP; Clifford W. Browning

(57) ABSTRACT

A compressor comprises an impeller wheel mounted within a housing defining an inlet and an outlet. The wheel has a plurality of vanes and is rotatable about an axis. The housing has an inner wall defining a surface located in close proximity to radially outer edges of the impeller vanes which sweep across said surface as the impeller wheel rotates about its axis. The inlet comprises a tubular wall extending away from the impeller wheel in an upstream direction. An enclosed chamber is defined between said inner wall and an outer wall and in communication with at least one opening in said in said inner wall. The outer wall is penetrated by at least one ventilation aperture that is designed to be connected via a conduit to a location upstream of the inlet and downstream of an air filter.

20 Claims, 6 Drawing Sheets

(56) References Cited

U.S. PATENT DOCUMENTS

| | | | | |
|---|---|---|---|---|
| 3,741,677 | A | 6/1973 | Silvern et al. | |
| 4,375,938 | A | 3/1983 | Dussourd | |
| 4,743,161 | A | 5/1988 | Fisher et al. | |
| 4,990,053 | A | 2/1991 | Rohne | |
| 5,246,335 | A | 9/1993 | Mitsubori et al. | |
| 6,447,241 | B2 | 9/2002 | Nakao | |
| 6,582,188 | B2 | 6/2003 | Rippl | |
| 7,204,241 | B2 | 4/2007 | Thompson et al. | |
| 7,326,027 | B1 * | 2/2008 | Skoch et al. | 415/17 |
| 8,256,218 | B2 * | 9/2012 | Nikpour | 60/605.1 |
| 2002/0192073 | A1 | 12/2002 | Japikse | |
| 2004/0223843 | A1 | 11/2004 | Cabrales et al. | |
| 2004/0223847 | A1 * | 11/2004 | Cvjeticanin et al. | 415/206 |
| 2007/0137201 | A1 | 6/2007 | Arnold et al. | |
| 2008/0292449 | A1 * | 11/2008 | Lefevre | 415/58.4 |
| 2011/0011379 | A1 | 1/2011 | Jackson | |

FOREIGN PATENT DOCUMENTS

| | | | | | |
|---|---|---|---|---|---|
| EP | 1473465 | A1 | | 11/2004 | |
| GB | 897575 | | | 5/1962 | |
| GB | 2305974 | A | * | 4/1997 | F04D 27/02 |
| JP | 52-011405 | A | | 1/1977 | |
| JP | 58-202399 | A | | 11/1983 | |
| JP | 60-50298 | A | | 3/1985 | |
| JP | 50-65898 | | | 3/1993 | |
| JP | 6-147195 | A | | 5/1994 | |
| WO | 0046509 | | | 8/2000 | |
| WO | 2004100004 | A1 | | 1/2004 | |
| WO | 2005068842 | A1 | | 7/2005 | |
| WO | 2007078667 | A1 | | 7/2007 | |

OTHER PUBLICATIONS

UK Intellectual Property Office, Search Report GB0701012.7, Cummins Turbo Technologies Limited, May 15, 2007.

* cited by examiner

COMPRESSOR

The present application is a continuation of U.S. Ser. No. 12/500,428 filed on Jul. 9, 2009 which is a continuation of PCT/GB2008/000176 filed on 18 Jan. 2008, which claims the benefit of British Patent Application No. 0701012.7 filed on Jan. 19, 2007, each of which are incorporated herein by reference.

BACKGROUND OF THE INVENTION

The present invention relates to a compressor. In particular, the invention relates to the inlet arrangement of a centrifugal compressor and to a turbocharger incorporating such a compressor.

A centrifugal compressor comprises an impeller wheel, carrying a plurality of blades (or vanes) mounted on a shaft for rotation within a compressor housing. Rotation of the impeller wheel causes gas (e.g. air) to be drawn into the impeller wheel and delivered to an outlet chamber or passage. In the case of a centrifugal compressor the outlet passage is in the form of a scroll volute defined by the compressor housing around the impeller wheel and in the case of an axial compressor the gas is discharged axially.

The turbocharger is a well-known device for supplying air to the intake of an internal combustion engine at pressures above atmospheric (boost pressures) and is widely used on automobiles and the like. The compressor of a turbocharger is driven by an exhaust gas turbine that is mounted on a common shaft. Exhaust gas from the internal combustion engine flows through the turbine and drives the turbine wheel in rotation, which, in turn, rotates the compressor impeller. Air is drawn through an axial inlet of the compressor housing and compressed air is delivered to the intake manifold of the internal combustion engine, thereby increasing engine power.

One aspect of turbocharger control is to ensure stable operation by avoiding what is known as surge. If the turbocharger is operating at a relatively low compressor volumetric air flow rate and a high boost pressure the air flow into the compressor may stall and the operation of the compressor is interrupted. Following stall, the air flow tends to reverse through the compressor until a stable pressure ratio is reached at which the air can flow in the correct direction. This process repeats and results in pulsations in the air flow known as surging. Maximum operating efficiency of the engine is achieved by operating close to the surge limit and a surge margin is built into the control process to ensure that the turbocharger operates at a safe distance from the surge condition.

In some turbochargers the compressor inlet has a structure that has become known as a "map width enhanced" (MWE) structure. An MWE structure is described for instance in U.S. Pat. No. 4,743,161. The inlet of such an MWE compressor comprises two coaxial tubular inlet sections, an outer inlet section or wall forming the compressor intake and inner inlet section or wall defining the compressor inducer, or main inlet. The inner inlet section is shorter than the outer inlet section and has an inner surface that is an extension of a surface of an inner wall of the compressor housing which is swept by edges of the impeller wheel blades. The arrangement is such that an annular flow path is defined between the two tubular inlet sections, the path being open at its upstream end and provided with apertures or a slot (hereinafter referred to as the "MWE slot") at its downstream end that communicate with the inner surface of the compressor housing that faces the impeller wheel. In operation, the MWE slot allows additional air to be drawn into the compressor under high flow (near choke) conditions, however its most important function is at lower flow rates and, in particular, as the compressor approaches surge. Under these conditions the MWE slot allows the flow to reverse (which is now the prevalent flow regime in parts of the compressor) and to be re-circulated to the intake, thus delaying surge.

It is well known that the MWE structure stabilises the performance of the compressor increasing the maximum flow capacity and improving the surge margin, i.e. decreasing the flow at which the compressor surges, so that the range of engine r.p.m. over which the compressor can operate in a stable manner is increased. A given compressor can thus be matched to engines with a wider speed range. This is known as increasing the width of the compressor "map", which is a plot of the compressor characteristic.

It has been shown that increasing the length of the inner inlet section and therefore the annular flow path improves the surge margin, as described in our European patent No. 1473465. However, the benefits can drop with increasing length particularly since the efficiency of such a compressor can be reduced.

It is also known in some compressor embodiments for the surge margin to be improved by allowing the MWE slot to be open to the surrounding engine environment. This can be achieved, for example by removing the outer inlet wall. An open MWE slot has safety and operational implications. In particular, hot air is discharged through the slot near surge and needs to be channel to an area where it is not a safety hazard. Moreover, it is possible that debris can be drawn into the compressor with air via the MWE slot when it is operating at high flow. In some circumstances it is possible that fragments of the vanes break off from the impeller wheel and are blown out of the MWE slot with obvious safety risks.

SUMMARY OF THE INVENTION

It is an object of the present invention to obviate or mitigate the aforementioned, and/or other disadvantages.

According to a first aspect of the present invention there is provided a compressor assembly comprising: a compressor housing defining a gas inlet and a gas outlet; a compressor impeller wheel having a plurality of vanes and mounted in the housing between said inlet and outlet, the wheel being rotatable about an axis; the housing having an inner wall defining a surface located in close proximity to radially outer edges of the impeller vanes which sweep across said surface as the impeller wheel rotates about its axis; the inlet comprising a tubular wall extending away from the impeller wheel in an upstream direction; the housing further comprising an enclosed chamber defined between said inner wall and an outer wall and in communication with at least one opening in said inner wall; the outer wall being penetrated by a plurality of ventilation apertures spaced around the outer wall; an elongate ventilation conduit having a first end connected to at least one of the ventilation apertures and a second end connected to a location upstream of the housing inlet.

The chamber may be of any suitable form but is enclosed substantially to eliminate or prevent hot gases being emitted locally or debris being drawn in towards the compressor. It may be, in particular, substantially annular. The chamber may be disposed between the inner wall of the housing and the outlet, which may be in the form of a scroll. It may also be disposed, at least in part, around a downstream end of the inlet adjacent to the impeller wheel.

It is to be understood that there may be more than one ventilation conduit.

The housing inlet may be connected to an elongate intake conduit such as a pipe and to which the second end of the ventilation conduit is connected. The second end of the conduit may be in communication with a gas filter, such as an air filter. This may be by virtue of a direct or indirect connection between the second end of the conduit and the filter or the intake conduit at a position downstream of the filter. The second end of the ventilation conduit may be connected to a casing of the filter. The second end of the ventilation conduit may be in communication with the intake conduit at a position between the gas filter and the housing inlet.

The outer wall can be of any suitable form to enclose the chamber. It may comprise a first portion that extends in a generally axial direction (i.e. substantially to parallel to the axis of rotation of the wheel) and a second portion that extends in a direction transverse to the first portion and meets with the tubular wall of the inlet. The second portion of the outer wall may extend in a substantially radial direction. The ventilation aperture may penetrate either the first or the second portions of the outer wall and in the event that there is more than one such aperture both wall portions may be penetrated. In embodiments where there is a plurality of ventilation apertures, such apertures are discrete and spaced around the outer wall.

The, or each, ventilation aperture may be non-annular. The outer wall may be connected to, or joined with, the tubular wall of the inlet at a position upstream of the impeller wheel, so that the chamber is enclosed, at least in part, between the two walls.

The area occupied by the ventilation aperture or the combined area occupied by the ventilation apertures may be equal to or greater than the area occupied by the opening in the inner wall.

The outer wall may be an integral part of the housing.

According to a second aspect of the present invention there is provided a turbocharger comprising a compressor as defined above and a turbine that drives said impeller wheel in rotation.

According to an third aspect of the present invention there is provided an internal combustion engine comprising a turbocharger as defined above, the engine having an air filter in communication with the compressor inlet, the ventilation aperture being connected by a ventilation conduit to a position between the inlet and the air filter.

According to a fourth aspect of the present invention there is provided a method for using a compressor in a turbocharger, the compressor comprising a housing defining a gas inlet and a gas outlet, and an impeller wheel having a plurality of vanes and mounted in the housing between said inlet and outlet, the method comprising the steps of: rotating the impeller wheel about an axis such that radially outer edges of the impeller vanes which sweep across a surface of an inner wall of the housing; allowing air to be drawn into the housing inlet towards the impeller wheel from an upstream location to a downstream location; providing an enclosed chamber between said inner wall and an outer wall, the chamber being in communication with the impeller wheel via at least one opening in said in said inner wall; allowing air to pass to the impeller wheel from the chamber via the opening or in the reverse direction; and allowing air to pass into or out of the chamber through a plurality of apertures in an outer wall of the chamber; and providing at least one ventilation conduit interconnecting the, or each, ventilation aperture and a port upstream of the housing inlet such that air is delivered to said port from said chamber for recirculation into said inlet or is drawn into the impeller from said port via the chamber and the opening in the inner wall.

According to a fifth aspect of the present invention there is provided a compressor assembly comprising: a compressor housing defining a gas inlet and a gas outlet; a compressor impeller wheel having a plurality of vanes and mounted in the housing between said inlet and outlet, the wheel being rotatable about an axis; the housing having an inner wall defining a surface located in close proximity to radially outer edges of the impeller vanes which sweep across said surface as the impeller wheel rotates about its axis; the inlet comprising a tubular wall extending away from the impeller wheel in an upstream direction; the housing further comprising an enclosed chamber defined between said inner wall and an outer wall and in communication with at least one opening in said inner wall; the outer wall being penetrated by at least one ventilation aperture; a ventilation conduit having a first end connected to the at least one ventilation aperture and a second end; an intake conduit connected to the gas inlet in the housing; a gas filter in communication with the intake conduit; the second end of the ventilation conduit being in communication with the intake conduit at a position that is adjacent to, but downstream of, the gas filter.

The second end of the ventilation conduit may be connected directly or indirectly to the intake conduit or to a housing or casing associated with the gas filter.

According to a sixth aspect of the present invention there is provided a method for using a compressor in a turbocharger, the compressor comprising a housing defining a gas inlet and a gas outlet, and an impeller wheel having a plurality of vanes and mounted in the housing between said inlet and outlet, the method comprising the steps of: rotating the impeller wheel about an axis such that radially outer edges of the impeller vanes which sweep across a surface of an inner wall of the housing; allowing air to be drawn into the housing inlet towards the impeller wheel from an upstream location to a downstream location; providing an enclosed chamber between said inner wall and an outer wall, the chamber being in communication with the impeller wheel via at least one opening in said in said inner wall; allowing air to pass to the impeller wheel from the chamber via the opening or in the reverse direction; and allowing gas to pass into or out of the chamber through at least one ventilation aperture in an outer wall of the chamber; and providing a ventilation conduit for delivering gas to a position adjacent to but downstream of a gas filter in communication with the inlet such that air is delivered to from said chamber for recirculation into said inlet or is drawn into the impeller from via the chamber and the opening in the inner wall.

BRIEF DESCRIPTION OF THE DRAWINGS

A specific embodiment of the present invention will now be described, by way of example only, with reference to the accompanying drawings, in which.

DETAILED DESCRIPTION OF THE PREFERRED EMBODIMENTS

Figure 2:
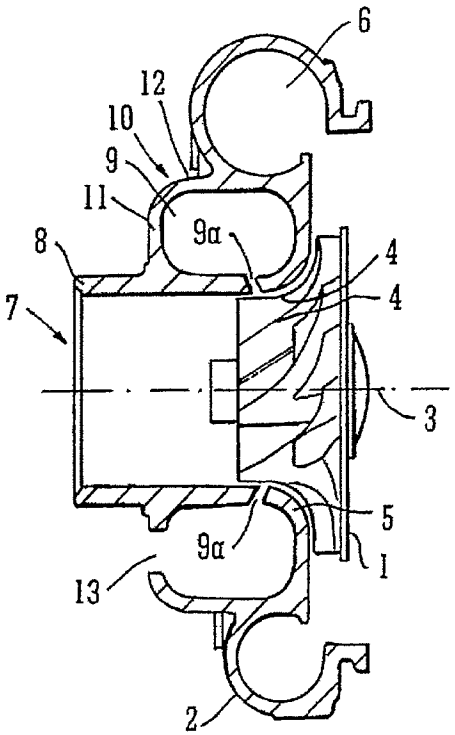
FIG. 2 is a sectioned side view of the compressor housing of FIG. 1.
Figure 1:
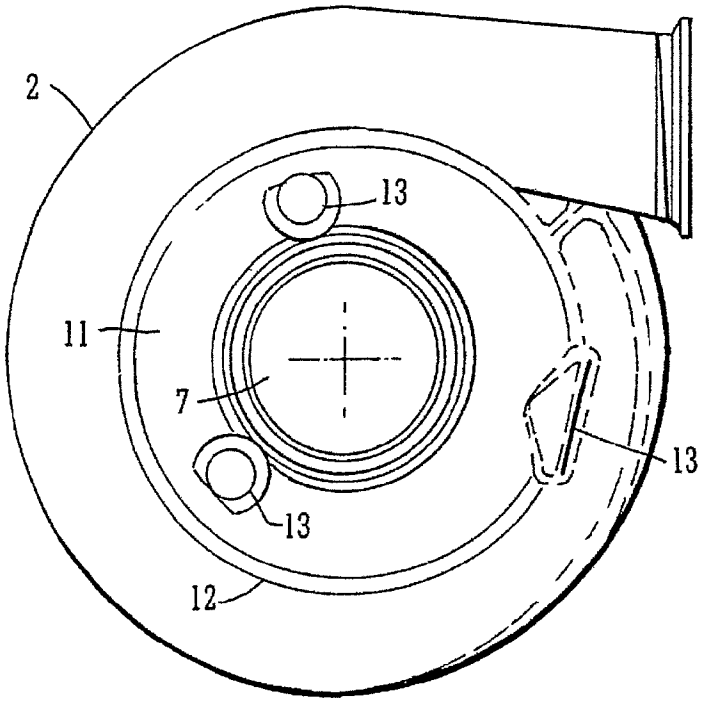
FIG. 1 is a front view of a compressor housing in accordance with the present invention.

Referring to FIGS. 1 and 2, the illustrated compressor is a centrifugal compressor of the kind used in a turbocharger. The compressor comprises an impeller wheel 1 mounted within a compressor housing 2 on one end of a rotating shaft that extends along a compressor axis 3. The wheel typically has a plurality of vanes 4 each of which has an outer edge that sweeps across an interior surface of an inner wall 5 of the housing when the impeller wheel rotates about the axis 3.

The compressor housing 2 defines an outlet scroll volute 6 surrounding the impeller wheel and a central air inlet port 7 defined by an annular wall 8 that extends coaxially with the compressor axis from an upstream end to a downstream end immediately adjacent to the impeller wheel 1. An integral MWE inlet structure in the form of an enclosed annular chamber 9 is disposed between the downstream end of the inlet port 7 and the outlet volute 6. An annular slot 9*a* provides gas communication between the impeller wheel and interior of the chamber 9. The housing 2 is a unitary cast structure and is designed to connect to a bearing housing (not shown) of the turbocharger.

The annular chamber 9 has an outer wall 10 with a front wall portion 11 that extends substantially radially relative to the compressor axis and a side wall portion 12 that is substantially concentric with the downstream end of the inlet port 7. The outer wall 10 is penetrated by three ventilation apertures 13 that provide communication between the chamber 9 and a location upstream of the inlet port 7. In the particular embodiment shown the front wall portion 11 is penetrated by two ventilation apertures 13 and the side wall portion 12 by one such aperture. It is to be understood that any suitable number and arrangement of apertures may be used depending on the engine requirements. The total area of the apertures 13 should be equal to or greater than the area of the slot 9*a* in order for the arrangement to work effectively.

Figure 3:
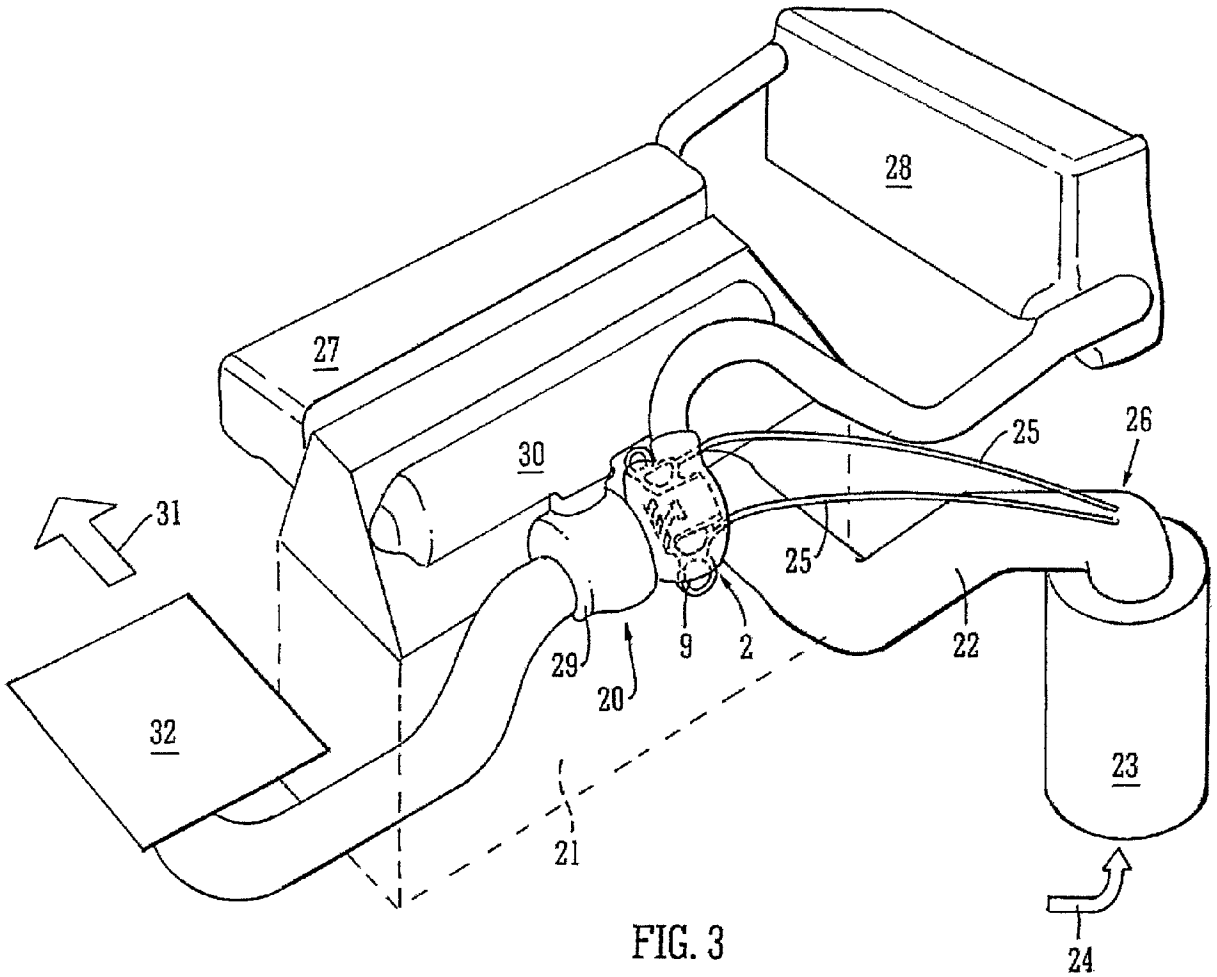
FIG. 3 is a schematic representation of the compressor of FIGS. 1 and 2 shown connected in-situ.

FIG. 3 shows the compressor 2 as part of a turbocharger 20 connected to an internal combustion engine 21 of a vehicle. The compressor inlet is connected to an elongate intake conduit 22 with an air filter 23 at one end that receives ambient air (represented by arrow 24). The ventilation apertures 13 in the annular chamber 9 of the compressor housing 2 are connected by conduits which in this case are flexible hoses 25 to a location 26 in the intake conduit 22 downstream of the air filter. For clarity only two of the three conduits are shown in FIG. 3. The compressor outlet supplies compressed air to the inlet manifold 27 of the internal combustion engine 21 via an after cooler 28 as is conventional. The turbine part 29 of the turbocharger 20 is shown with its inlet connected to the exhaust manifold 30 of the internal combustion engine 21 and its outlet to exhaust 31 via a silencer 32.

In operation, the turbine 29 is driven in rotation by the exhaust gases from the engine in the usual manner and the consequent rotation of the compressor impeller 1 causes air to be drawn in through the air filter 23, along the intake conduit 22 to the compressor inlet port 7. The air pressure in the chamber 9 is normally lower than atmospheric pressure and during high gas flow, the pressure of the air in the area swept by the impeller air is even less. Thus air is drawn from the annular chamber 9 via the annular slot 9*a* to increase the volume of air flow reaching the impeller 1. As the air flow drops the flow from the annular chamber 9 decreases until equilibrium is reached. A further drop in the impeller wheel flow results in the pressure in the area swept by the impeller wheel 1 increasing above that in the chamber 9 and thus there is a reversal in the direction of flow of air through the annular slot 9*a*. That is, under such conditions the air flows outwards from the impeller wheel 1 into the chamber 9 and out through the ventilation apertures 13 and the conduits 25 to a location adjacent to, but downstream of, the air filter 23 where it is returned to the compressor intake conduit 22 for recirculation. This ensures that clean air is drawn into the compressor when it operates in the region in the middle of the conventional compressor map and near the choke condition.

Figure 4A:
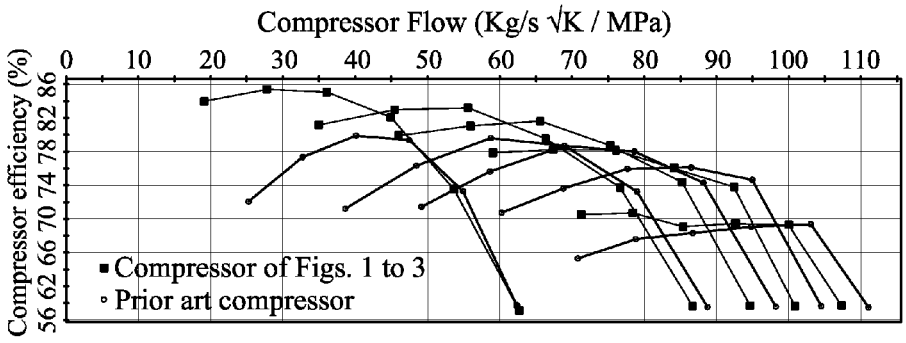
FIGS. 4*a* and 4*b* are compressor maps illustrating the performance of the compressor of FIGS. 1 to 3 compared to the performance of a compressor with a conventional MWE structure.
Figure 4B:
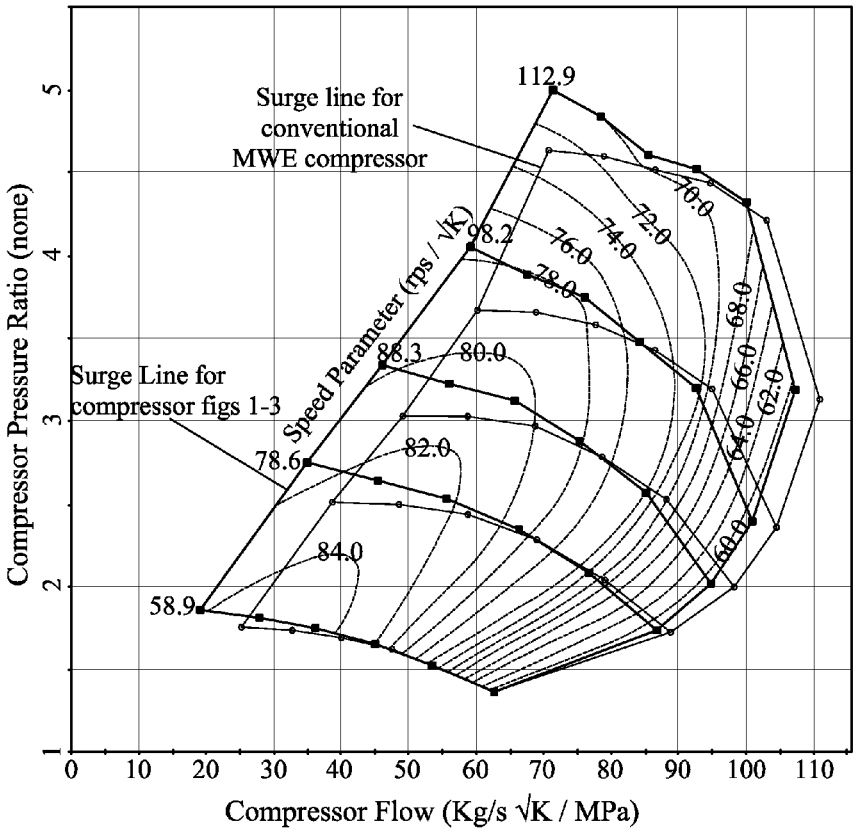

This arrangement maintains the advantages of a conventional MWE structure in that it serves to stabilise the performance of the compressor by increasing the maximum flow capacity and improving the surge margin i.e. decreasing the flow at which the compressor surges. However, initial tests have established that there is an approximately 20% improvement in the surge flow for the compressor of FIGS. 1 to 3 as compared to a compressor with a conventional MWE structure and as illustrated by reference X in the compressor map of FIG. 4*b*. The efficiency of the compressor also improves in comparison to a conventional compressor as illustrated by the graph of FIG. 4*a*. In addition, the risk of debris being drawn into the compressor via the annular slot 9*a* is eliminated. Moreover, in the event that the compressor wheel 1 is damaged e.g. fragments break way from the impeller or the wheel shatters, this can be contained such that the fragments are not thrown at high velocity from the compressor.

Figure 5A:
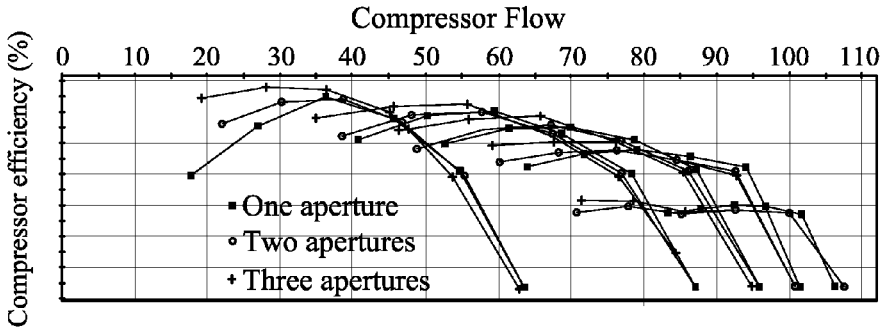
FIGS. 5*a* and 5*b* are compressor maps providing a comparison of the performance of the compressor of FIGS. 1 to 3 which has three ventilation conduits with equivalent compressors having one and two ventilation conduits.
Figure 5B:
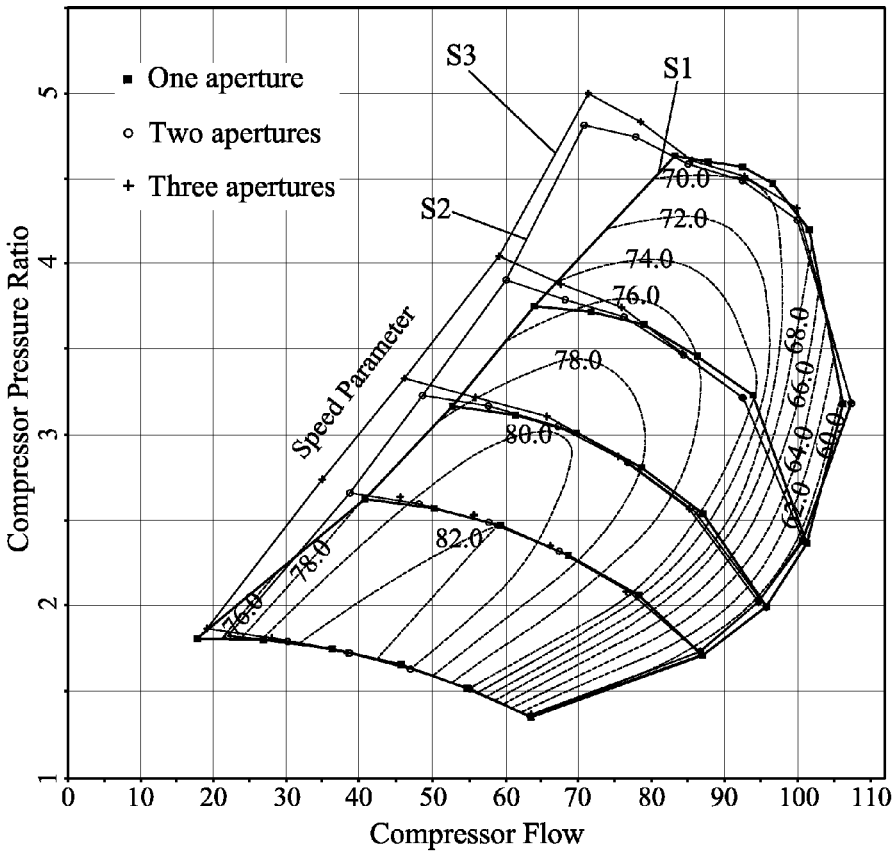

In FIGS. 5*a* and 5*b* the efficiency and compressor maps are shown for the same compressor having one, two or three ventilation apertures. The surge line for each compressor is indicated in each case by reference Sn where n is the number of ventilation apertures. It will be readily appreciated that the surge line moves significantly to the left of the graph as the number of ventilation apertures is increased from one to two and even further if increased to three. The surge margin thus increases significantly by adopting more than one ventilation aperture (and therefore more than one ventilation conduit).

Figure 5C:
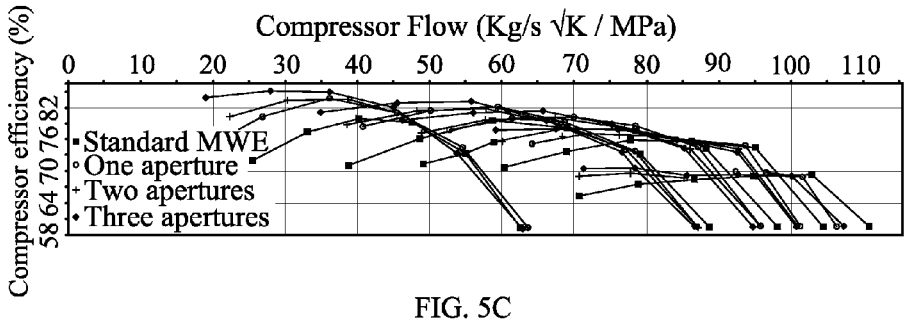
FIGS. 5*c* and 5*d* are compressor maps providing a comparison of the performance of compressor having one, two and three ventilation apertures and conduits with a conventional "standard" MWE structure.
Figure 5D:
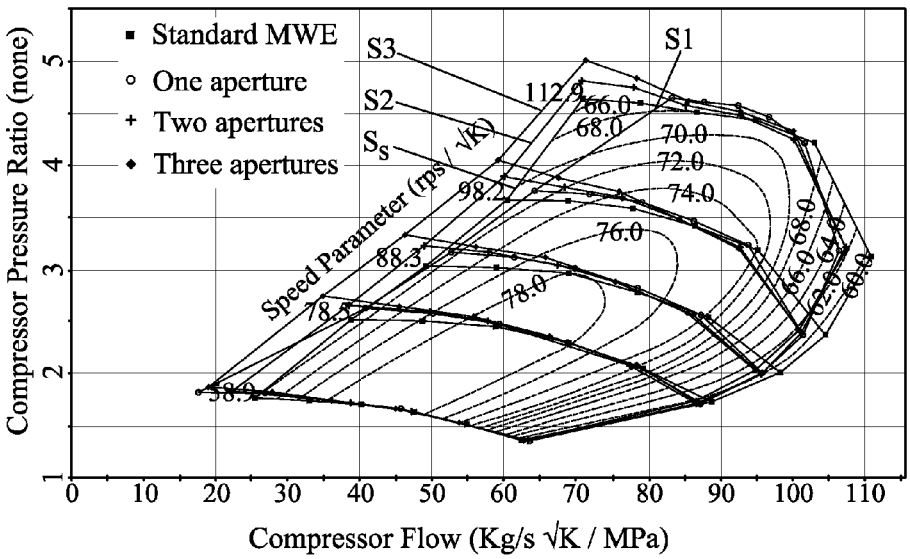

In FIGS. 5*c* and 5*d* the compressor maps of FIGS. 5*a* and 5*b* are shown again alongside a compressor map for a comparable compressor with a conventional or "standard" Cummins MWE inlet structure (Cummins compressor part number 3598174), which is described above in relation to the prior art. For convenience and clarity such a structure can be summarised as having an inlet with coaxial inner and outer tubular inlet sections. The outer inlet section forms the compressor intake and inner inlet section defines the compressor inducer, or main inlet. The inner inlet section is shorter than the outer inlet section and has an inner surface that is an extension of a surface of an inner wall of the compressor housing which is swept by edges of the impeller wheel blades. The surge line for the compressor with the standard MWE structure is labelled Ss. It will be noted from these results that the surge line $S_1$ for the compressor with a single ventilation aperture and conduit moves to the right of the surge line Ss for the compressor with the standard MWE inlet structure in the regions of interest (the middle to the top of the map of 5d). The tests thus established, somewhat surprisingly, that there is no benefit to using a single ventilation aperture and conduit in comparison to conventional technology and benefit is only obtained by using two, three or more ventilation apertures.

It is thought that using only a single ventilation aperture can be problematic in that some of the MWE flow in the annular chamber has to travel a significant distances around the chamber before it can exit through the aperture. This, coupled with the resistance to flow afforded by the walls of the annular chamber serves to increase the likelihood that at low flow rates the reverse MWE flow will pass to intake of the compressor impeller rather than entering the annular chamber of the MWE inlet structure. This means that the compressor impeller blades will have a greater tendency to stall, leading to the cyclic surging phenomenon.

Figure 6:
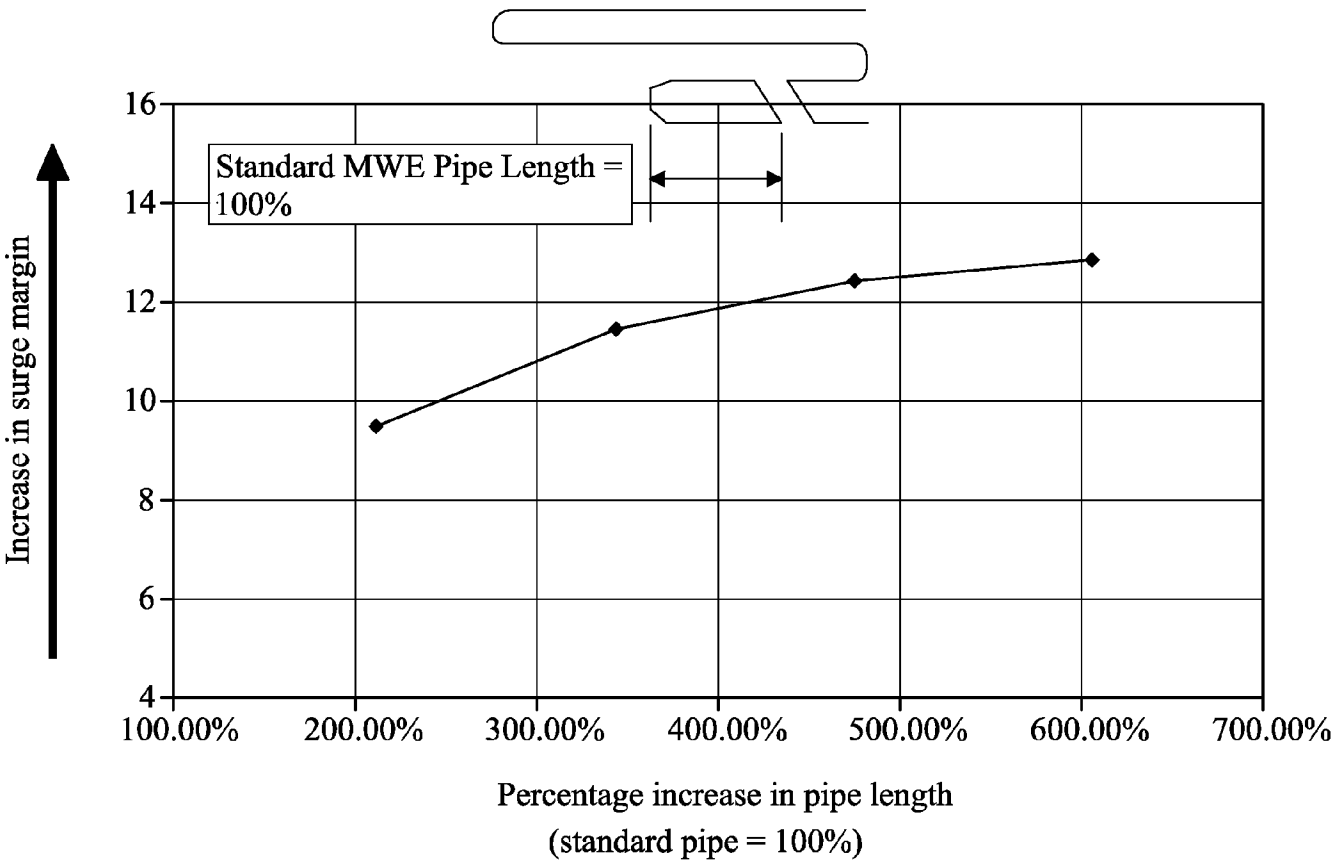
FIG. 6 is a graph showing the effect of increasing the length of the ventilation conduit on the surge margin of the compressor.

As discussed above, the ventilation conduits may be connected to any convenient location downstream of the engine air filter so that air is recirculated to the compressor intake conduit 22. It has been established that the longer the length of the ventilation conduit, the greater the increase in surge margin. This is illustrated by the graph of FIG. 6, which is a plot of the percentage increase in conduit length relative to the length of a standard Cummins MWE inlet structure (present in Cummins compressor housing part no. 3598174) against the increase in surge margin. The length of the standard MWE inlet structure is a distance measured along the inner inlet section from the inner edge of the MWE slot to the tip, as illustrated by the sketch shown at the top of the graph. It will be appreciated that the sketch shows a section through the inner and outer inlet sections on one side of the axis of the compressor housing only. In this instance the length is 24 mm, which is 36% of the inducer diameter of the compressor housing.

It will be appreciated that numerous modifications to the above described designs may be made without departing from the scope of the invention as defined in the appended claims. Examples are described below.

The precise number and location of the ventilation apertures in the chamber will vary dependent on the engine configuration. At least one aperture is required and in practical terms there may be up to 7 or 8 or even more depending on the size of each aperture. Moreover, the conduits may connect to any convenient location downstream of the engine air filter.

In one preferred embodiment the ventilation conduits are of such a length that they extend at least 95% of the distance from the respective ventilation aperture to the air filter. In alternative embodiments the length of the conduits may be less such as, for example 90% of the aperture to filter distance. Further conduit length alternatives include, for example at least 7%, 15%, 30%, 50% or 70% of the aperture to filter distance. The conduits may for example connect to the compressor intake conduit within 60 cm, 30 cm, 20 cm, 10 cm or most preferably 5 cm of the connection between the compressor intake conduit and a casing of the air filter. In terms of ventilation conduit length, each may extend further than 5 cm, 10 cm, 20 cm, 30 cm, 60 cm, or most preferably 100 cm upstream of the compressor inlet. The ventilation conduits may each be of the same length as one another, or may be of different lengths. In the latter case the conduits may be connected to ports in the compressor intake conduit that are located at equi-spaced or irregularly spaced intervals and at the same or different circumferential positions. The conduits may be connected to the air filter casing upstream or downstream of a filter therein, to a location upstream of the filter, to an engine radiator, or to an air cooler which may in turn be connected to any of the aforementioned locations. Multiple ventilation conduits may be joined together away from the compressor to form a bundle of conduits, or alternatively may be configured so as to merge to form a reduced number of conduits, preferably just one, which may be connected to any of the aforementioned locations.

The annular chamber of the MWE inlet structure may be divided into segments which may be of equal or different sizes and shapes and which may be separated by partial or complete walls. Each segment may have a respective ventilation aperture and conduit. Alternatively, two or more adjacent segments may share a common aperture and conduit.

The ventilation apertures and conduits may extend from the chamber in a direction that is parallel to the rotary axis of the compressor impeller or may extend inwardly towards the axis or outwardly away therefrom. Each aperture and/or conduit may take any suitable shape and may have any suitable cross-sectional area and these may vary between each other. The apertures and conduits may be equi-angularly spaced about the compressor axis, or may be irregularly spaced. The apertures may be circular, oval or slot shaped with the slots extending angularly at least 5 or at least 10 degrees.

The annular slot 9*a* of the MWE inlet structure may be configured to direct the MWE air or gas flow in a direction that is parallel to the direction of the ventilation apertures. Two or more ventilation apertures may be configured to direct the air or gas flow to a common conduit.

The arrangements described above may be applied to an electrically driven compressor and to turbochargers having a motor and/or generator such as for use in a hybrid system, and to fuel-cell gas compressors where the working fluid may be any gas used in the combustion process.

While the invention has been illustrated and described in detail in the drawings and foregoing description, the same is to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" etc. used in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. An apparatus comprising:

a compressor assembly comprising:

a compressor housing defining an inlet and an outlet;

a compressor impeller wheel having a plurality of vanes and mounted in the housing between said inlet and outlet, the wheel being rotatable about an axis;

the housing having an inner wall defining a surface located in close proximity to radially outer edges of the impeller vanes which sweep across said surface as the impeller wheel rotates about its axis;

the inlet comprising a tubular wall extending away from the impeller wheel in an upstream direction;

the housing further comprising an enclosed chamber defined between said inner wall and an outer wall and in communication with at least one opening in said inner wall;

the outer wall being penetrated by a plurality of ventilation apertures spaced around the outer wall of the chamber;

wherein there is provided a ventilation conduit connected to each of the plurality of ventilation apertures and the second end of each of the ventilation conduits is connected to an intake conduit that is connected to the housing inlet.

2. The apparatus to claim 1, wherein the housing gas is connected to an intake conduit in communication with a filter and the second end of the ventilation conduit is in communication with the intake conduit at a position between the filter and the housing inlet.

3. The apparatus according to claim 2, wherein the second end of the ventilation conduit is in communication with the intake conduit at a position adjacent to, but downstream of, the filter.

4. The apparatus according to claim 1, wherein the enclosed chamber is substantially annular.

5. The apparatus according to claim 1, wherein the enclosed chamber is disposed between the inner wall and the outlet.

6. The apparatus according to claim 1, wherein the outlet is a scroll.

7. The apparatus according to claim 1, wherein the enclosed chamber is disposed, at least in part, around a downstream end of the inlet adjacent to the impeller wheel.

8. The apparatus according to claim 1, wherein the outer wall has a first portion that extends in a generally axial direction and a second portion that extends in a direction transverse to the first portion and meets with the tubular wall of the inlet.

9. The apparatus according to claim 8, wherein the second portion extends in a substantially radial direction.

10. The apparatus according to claim 1, wherein the outer wall has a first portion that extends in a generally axial direction and a second portion that extends in a direction transverse to the first portion, at least one of said plurality of ventilation apertures penetrating the second portion of the outer wall.

11. The apparatus according to claim 1, wherein the outer wall has a first portion that extends in a generally axial direction and a second portion that extends in a direction transverse to the first portion, at least one of the plurality of ventilation apertures penetrating the first portion of the outer wall.

12. The apparatus according to claim 1, wherein the, or each, ventilation aperture is non-annular.

13. The apparatus according to claim 1, wherein the outer wall is connected to the tubular wall of the inlet at a position upstream of the opening.

14. The apparatus according to claim 1, wherein the combined area occupied by the plurality of ventilation apertures is equal to or greater than the area occupied by the opening in the inner wall.

15. The apparatus according to any claim 1, wherein the outer wall is an integral part of the housing.

16. The apparatus according to claim 1, wherein the second end of the ventilation conduit is connected to an intake conduit that is connected to the housing inlet.

17. The apparatus according to claim 1, wherein the at least one opening in said inner wall is substantially annular.

18. The apparatus according to claim 1, wherein the vanes of the impeller sweep over the least one opening in the inner wall.

19. The apparatus according to claim 1, further comprising: a turbocharger comprising the compressor assembly; and a turbine that drives said impeller wheel in rotation.

20. The apparatus according to claim 1, further comprising:

an internal combustion engine fitted with the turbocharger, the engine having a filter in communication with the compressor inlet, the ventilation aperture being connected by a ventilation conduit to a position between the inlet and the filter.

* * * * *